US006513749B1

(12) United States Patent
Zimmermann et al.

(10) Patent No.: US 6,513,749 B1
(45) Date of Patent: Feb. 4, 2003

(54) YARN WINDING MACHINE AND METHOD

(75) Inventors: Karsten Zimmermann, Wuppertal (DE); Jörg Spahlinger, Wermelskirchen (DE); Martin Wagener, Köln (DE)

(73) Assignee: Barmag AG, Remscheid (DE)

( * ) Notice: Subject to any disclaimer, the term of this patent is extended or adjusted under 35 U.S.C. 154(b) by 0 days.

(21) Appl. No.: 09/723,935

(22) Filed: Nov. 28, 2000

(30) Foreign Application Priority Data

Dec. 9, 1999 (DE) ..... 199 59 382

(51) Int. Cl.[7] ..... B65H 54/22; B65H 63/00; B06F 19/00

(52) U.S. Cl. ..... 242/478.2; 242/484.9; 242/486; 700/80; 700/126

(58) Field of Search ..... 242/470, 478.2, 242/484.9, 486; 700/126, 80

(56) References Cited

U.S. PATENT DOCUMENTS

| | | | | |
|---|---|---|---|---|
| 4,344,582 A | * | 8/1982 | Rapp et al. | 242/470 X |
| 4,487,374 A | * | 12/1984 | Sugioka et al. | 242/474.5 |
| 4,534,042 A | * | 8/1985 | Marsicek et al. | 242/470 X |
| 4,588,339 A | | 5/1986 | Bilz | |
| 4,765,552 A | * | 8/1988 | Sugioka et al. | 242/486 |
| 4,890,306 A | | 12/1989 | Noda | |
| 5,100,072 A | | 3/1992 | Behrens et al. | |
| 5,844,494 A | * | 12/1998 | Spahlinger | 340/677 |
| 5,900,553 A | * | 5/1999 | Hasegawa | 242/484.9 X |
| 5,918,829 A | * | 7/1999 | Fah | 242/478.2 X |
| 5,927,636 A | * | 7/1999 | Rafflenbeul | 242/470 |
| 6,149,097 A | * | 11/2000 | Ludwig et al. | 242/486 X |
| 6,286,778 B1 | * | 9/2001 | Kudrus | 242/486.6 |

FOREIGN PATENT DOCUMENTS

| | | |
|---|---|---|
| DE | 43 35 256 A1 | 4/1994 |
| DE | 100 39 093 A1 | 3/2001 |
| EP | 0 155 662 A2 | 9/1985 |
| EP | 0 426 979 A2 | 5/1991 |
| EP | 0 460 546 B1 | 12/1991 |
| EP | 0 620 108 A1 | 10/1994 |
| EP | 0 922 797 A2 | 6/1999 |

* cited by examiner

*Primary Examiner*—Michael R. Mansen
*Assistant Examiner*—Minh-Chau Pham
(74) *Attorney, Agent, or Firm*—Alston & Bird LLP

(57) ABSTRACT

A yarn winding machine for winding at least one yarn and a method of controlling such a winding machine. In the winding machine, a plurality of rotatably driven components are used, whose drives are controlled via a controller. A data module is associated to at least one of the components, with the data module being writable and/or readable by the controller.

19 Claims, 2 Drawing Sheets

YARN WINDING MACHINE AND METHOD

BACKGROUND OF THE INVENTION

The present invention relates to a winding machine for winding at least one yarn, as well as a method of controlling such a winding machine.

In the production of synthetic multifilament yarns, the yarns are each wound, after spinning and drawing, to a package by means of winding machines. Winding machines of this kind, as are known, for example, from EP 0 460 546 and corresponding U.S. Pat. No. 5,100,072, comprise one or more winding spindles, which mount one or more winding tubes for receiving the packages. In these winding machines, the winding spindle is driven such that the circumferential speed of the package being wound is the same as the speed of the advancing yarn. To realize very high speeds of the advancing yarn, which may amount to more than 10,000 m/min in high-speed spinning processes, it is necessary that, depending on the diameter of the package, the winding spindle operate at very high rotational speeds, in particular at the start of the package winding. While the spindle speed decreases during the winding operation, the enlarging packages will lead to a considerable dead load. It is therefore necessary to withstand stresses, which come very close to the limits of material strength, and lead to considerable wear and tear in particular in sliding pairs. The consequence of such high speeds of the advancing yarn is that they limit the service life of components, which are rotatably driven in a winding machine.

It is accordingly an object of the invention to further develop a winding machine of the described type such that rotatably driven components of the winding machine are prevented from being overloaded despite the very high winding speeds.

It is a further object of the invention to provide a method of controlling the winding machine, which ensures regular maintenance of wearing components.

SUMMARY OF THE INVENTION

The above and other objects and advantages of the present invention are achieved by the provision of a yarn winding machine and method which comprises a plurality of components rotatably mounted on a machine frame, a drive for rotatably driving each of the components, a controller for controlling each of the drives, and a data module associated with at least one of the components. The data module is connected to the controller so as to be writable and/or readable by the controller.

The special advantage of the invention lies in that as a result of associating a data module to the rotatably driven machine component, it is possible to identify the component in the winding machine and to thus use it in a controlled manner during the operating time. In this connection, there exists the possibility that on the one hand data stored in the data module can be read and evaluated directly by the controller, or that the controller stores in the data module parameters that occurred during the operating time of the component. Such data may thus be taken from the data module while performing maintenance work.

A special advantage of the invention also lies in that after completion of maintenance, the data contained in the data module are also taken into account, when the component is reused.

In a particularly advantageous further development of the winding machine according to the invention, the data module is designed and constructed with storage capabilities for the purpose of receiving data. In this instance the data stored in the memory of the data module are readable by the controller. This permits recording a data set in the data module of the component for each winding cycle. Thus, it is possible to store in the data module without a gap the service life of the component in the form of data. In this connection, suitable data include machine unit data, function data and/or operating data. Machine unit data may indicate, for example, the diameter of the winding spindle. Information about the number of spinning positions in the winding machine could be contained in the function data. With the operating data, it becomes possible to predetermine in the data module the maximally allowable operating adjustments, such as maximum speed or maximum dead load. Thus, the data set is formed in the data module from permanently stored data, variable data, as well as data that are constantly added during the service life of the component. Reading and writing of the data sets occur via the respective controller of the winding machine.

To be able to store operating data that are relevant for the service life of the component, a sensor arrangement connected to the controller may be provided for gathering operating data that are realized by the component. Thus, for example, in the case of a winding spindle, it is possible to measure its rotational speed, and to compute therefrom accordingly within the controller the load cycles performed by the component.

To be able to use the component after its maintenance in any winding machine, the data module may be permanently joined to the component, so that an exchange of the component occurs only together with the data module.

To connect the data module to the controller, it is advantageous to provide a plug-in connection, which is simple to disengage and engage.

The data module, which preferably is a microchip having small dimensions, may advantageously be integrated in a winding spindle or a contact roll. However, there exists likewise the possibility of linking such a data module with other components, which are subjected to wear and tear and should be serviced at regular intervals during the service life of a winding machine.

The method of the present invention distinguishes itself in that the component operated in the winding machine is operated in a controlled manner and not in a manner exceeding material limits. In this process, the data set associated to the component is read in the data module for purposes of controlling the drive of the component as a function of the read data. This ensures that, for example, a predetermined maximum speed of the component is not exceeded.

The method of the invention also has the special advantage that the operating data realized by the component during the operating time will always be available. To this end, thes data are gathered during the operating time and stored as a data set in the data module.

To prevent an overload of the particular component in the winding machine, it is especially advantageous to use an embodiment of the method wherein the operating data contain information regarding the allowable load cycles. The allowable load cycles $L_{max}$ are stored in the data module, and are read by the controller. During the operation of the winding machine, the performed load cycles $L_A$ are acquired and compared with the allowable load cycles $L_{max}$. In the event that the performed load cycles $L_A$ exceed the number of the allowable load cycles $L_{max}$, an alarm signal will be generated, and the machine is shut down. However, it is also possible that a lower limit value is predetermined in addition to the maximally allowable load cycles. In the event that the completed load cycles exceed the tolerance limit, it would be likewise possible to generate an alarm signal, which results, however, only in a maintenance and in no machine shutdown.

It is also possible that after a prescribed maintenance of the component, the stored data of the data module either acquire this maintenance simultaneously in terms of data or that they are reset by a change (for example, a reset) to a predetermined value.

The winding machine of the present invention and method of controlling such a winding machine according to the invention are especially suited for winding in spin processes a yarn at very high yarn speeds of more than 8,000 m/min. In this connection, the controller of the winding machine is advantageously connected to a spinning line controller, so as to permit corresponding interventions in the process control of the spinning line, when a machine is shut down.

BRIEF DESCRIPTION OF THE DRAWINGS

In the following, both an embodiment of the invention and the method of the present invention are described in greater detail with reference to the drawings, in which.

DETAILED DESCRIPTION OF THE PREFERRED EMBODIMENT

Figure 1:
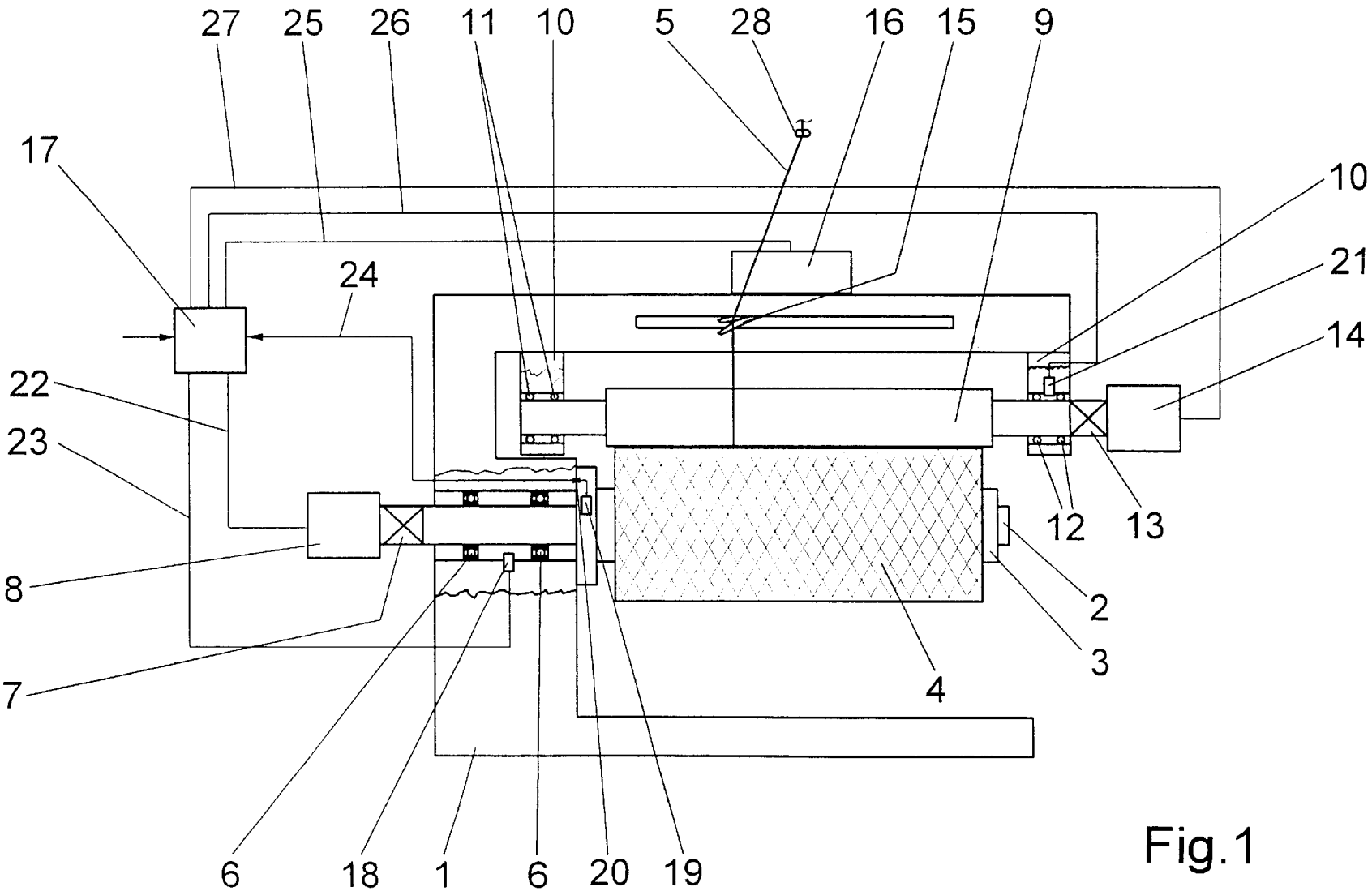
FIG. 1 is a schematic view of an embodiment of a winding machine according to the invention.

FIG. 1 schematically illustrates an embodiment of the winding machine according to the invention. The winding machine comprises a machine frame 1, which mounts a winding spindle 2 in cantilever fashion. The winding spindle 2 is rotatably supported in a bearing 6. In the embodiment of the winding machine according to the invention as illustrated in FIG. 1, the bearing 6 is directly accommodated in the machine frame 1. However, in such winding machines, the winding spindle may be advantageously held in a movable support or turret, which is adapted for movement inside the machine frame in such a manner that the winding spindle is able to perform a deflection, during the winding of the package. For the sake of clarity, such a movable support has been omitted in FIG. 1.

On its projecting portion, the winding spindle 2 mounts a winding tube 3. The winding tube 3 is used to receive a package 4, on which a yarn 5 is wound. In this process, the winding spindle 2 is driven by a spindle drive 8. The spindle drive 8 connects to the winding spindle 2 via a coupling 7.

Upstream of the winding spindle 2, a contact roll 9 is rotatably supported in the machine frame 1. To this end, the contact roll 9 is held at its ends with bearings 11 and 12 in a rocker arm 10. The rocker arm 10 is arranged for rotation in the machine frame 11, so as to permit an increase of the package diameter during the winding of package 4. In the axial extension of contact roll 9, a drive 14 is coupled with contact roll 9. Between contact roll 9 and drive 14, a coupling 13 is formed.

In the direction of the advancing yarn upstream of the contact roll 9, the machine frame 1 mounts a yarn traversing device 15 of the rotary blade type. The rotary blade type traversing device is driven via a drive 16 such that it reciprocates the yarn 5 within a traverse stroke. To this end, the yarn 5 advances to the rotary blade type traversing device via a yarn guide 28.

To control the winding machine, a controller 17 is provided. The controller 17 connects via a control line 22 to spindle drive 8, via a control line 25 to drive 16 of the traversing device, and via a control line 27 to contact roll drive 14. To measure the spindle speed and the rotational speed of the contact roll, a sensor arrangement is provided, which is formed by sensors 18 and 21. The sensor 18 is arranged in the bearing region of winding spindle 2, and it connects via a signal line 23 to controller 17. The sensor 21 is arranged on machine frame 1 in the bearing region of contact roll 9, and it connects via a signal line 26 to controller 17. A data line 24 connects the controller 17 to a data module 19. The data module 19 is arranged on winding spindle 2. To this end, a plug-in connection 20 is provided on machine frame 1. The plug-in connection serves to couple the data line 24 between controller 17 and data module 19. The winding spindle 2 is made exchangeable. To this end, the winding spindle 2 is removable from machine frame 1 together with the data module 19.

A yarn 5 continuously advances to the winding machine. In so doing, the yarn 5 advances through yarn guide 28 and reaches the rotary blade type traversing device 15, wherein the drive 16 rotatably drives rotary blades in two adjacent planes in opposite directions. In this process, the rotary blades alternately reciprocate yarn 5 within a traverse stroke. Thereafter, the yarn partially loops about contact roll 9, and is deposited on package 4. To this end, the winding spindle is driven by spindle drive 8. To attain a constant circumferential speed of the package, and thus a constant yarn speed, the spindle drive 8 is controlled by controller 17. In so doing, the controller 17 determines the rotational speed necessary for winding spindle 2 from the rotational speed of contact roll 9, which is measured by sensor 21. The rotational speed of contact roll 9 is adjusted substantially to a constant value and controlled by contact roll drive 14 and controller 17.

At the beginning of the winding operation, the operating data of winding spindle 2, which are stored in data module 19, are read via controller 17 for purposes of taking into account corresponding limit value adjustments in the control of the spindle drive.

Figure 2:
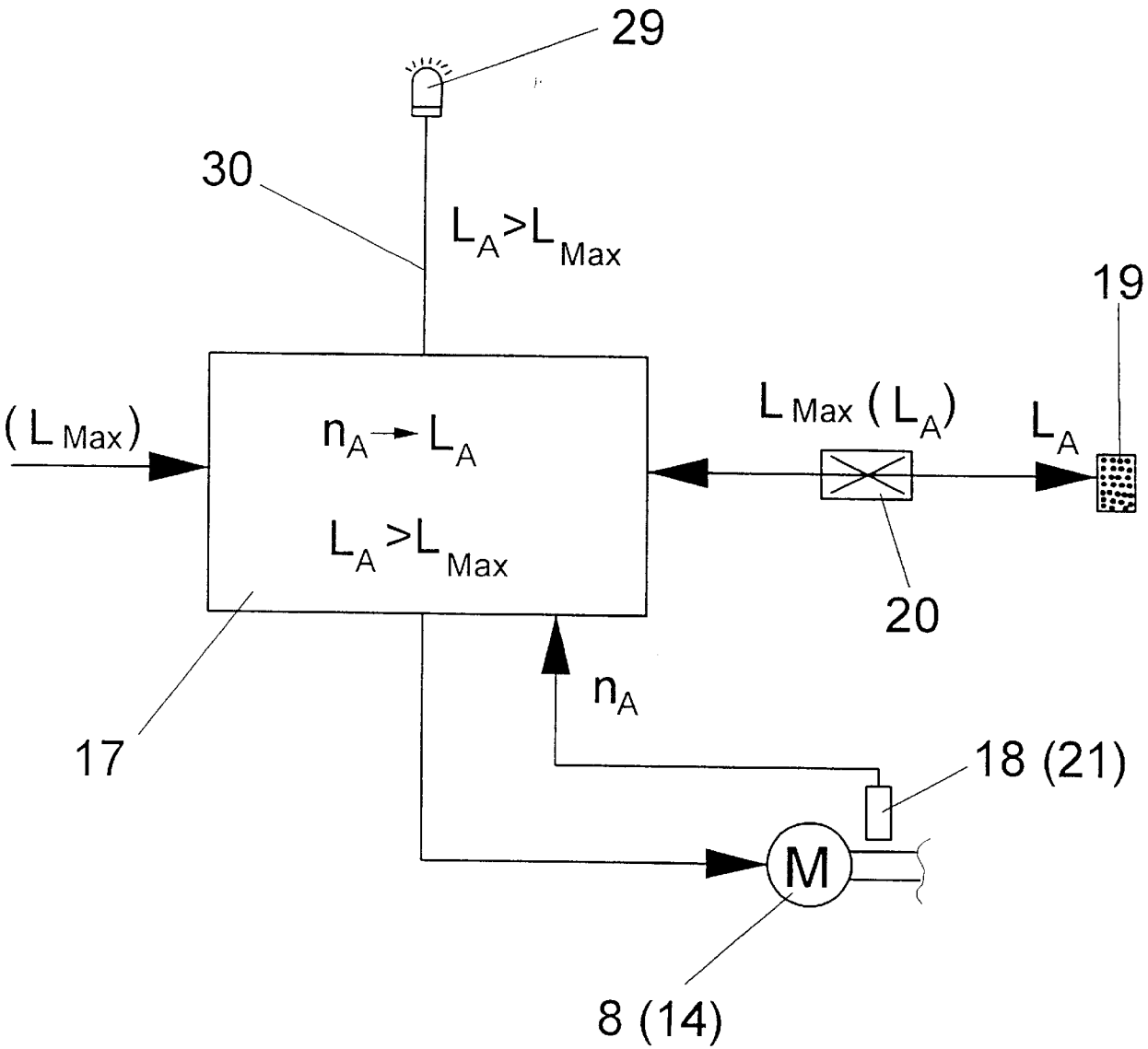
FIG. 2 is a schematic view of a signal diagram of the control system of the winding machine according to the invention as shown in FIG. 1.

FIG. 2 schematically illustrates a signal diagram of the control system, which contains the interaction of the controller 17 and data module 19. The data module 19 connects via data line 24 and plug-in connection 20 to controller 17. In the data module 19, the maximally allowable number of load cycles for winding spindle 2 is indicated at $L_{max}$. This number of load cycles is read by controller 17. During the operating time, the spindle drive 8 is controlled by controller 17. To this end, the controller 17 is connected via control line 22 to spindle drive 8. The rotational speeds realized by winding spindle 2, are measured by sensor 18 and supplied via signal line 23 to controller 17. Inside controller 17, the rotational speeds are converted by predetermined parameters to completed load cycles $L_A$. The load cycles completed by the winding spindle are computed in the controller substantially based on the number of revolutions and the rotational speed of the winding spindle. The completed load cycles $L_A$ thus reflect the load cycles completed by winding spindle 2. In the controller 17, a constant comparison occurs between the load cycles $L_A$ completed by winding spindle 2 and the maximally allowable load cycles $L_{max}$. In the event that the load cycles $L_A$ completed by winding spindle 2 exceed the maximally allowable load cycles $L_{max}$, the controller will generate an alarm signal and indicate it by means of a signaling lamp 29. To this end, the signaling lamp 29 connects to controller 17 via a signal line 30. The winding machine is shut down and will be reusable only after a maintenance of the winding spindle. Besides the constant adjustment between allowable load cycles and maximally completed load cycles, the completed load cycles $L_A$ are continuously stored in the data module. With that, there exists the possibility that after a change of the spindle for maintenance, the controller 17 will be able to read, besides the maximally allowable number of load cycles $L_{max}$, the number of load cycles $L_A$ already completed by the winding spindle.

There also exists the possibility of using the data module 19 exclusively for storing the completed load cycles. The maximally allowable load cycles of the winding spindle 2 are already preset and stored in controller 17, as is indicated in FIG. 2 by the value in parentheses ($L_{max}$).

FIG. 2 shows the signal diagram of the control system with a data module associated to the winding spindle. In the event that the data module is associated to the contact roll, the numerals shown in parentheses will apply. The control system is analogous to the foregoing description.

In the embodiment shown in FIGS. 1 and 2, the winding machine of the present invention comprises a data module only on one component. The embodiment can easily be extended by a further data module, which is associated to the contact roll. The data module of the contact roll is tied in as described and shown in FIG. 2. The controller may thus be coupled via a plurality of data lines to a plurality of data modules. In the event that the winding machine comprises two winding spindles mounted to a movable support, a data module is associated to each of the winding spindles and separately connected to the controller. Basically, all components that are subjected to increased wear and tear and must be serviced at regular time intervals, may receive a data module, which contains the allowable operating data. The winding machine of the present invention distinguishes itself in particular by its high reliability in operation.

That which is claimed:

1. A winding machine for winding at least one synthetic multifilament yarn into a package, comprising a plurality of components rotatably mounted on a machine frame, a drive for rotatably driving each of the components, a controller for controlling each of the drives, a data module affixed to at least one of the components, with said data module being connected to the controller so as to be writable and/or readable by the controller, and wherein the data module and the at least one component are removably mounted to the machine frame so as to permit them to be exchanged.

2. The winding machine as defined in claim 1 wherein the one data module has a memory for purposes of receiving and storing data and wherein the stored data is readable by the controller.

3. The winding machine as defined in claim 2 wherein the stored data includes machine unit data, function data, and/or operating data.

4. The winding machine as defined in claim 2 further comprising a sensor for detecting operating data of the at least one component, with the sensor being connected to the controller.

5. The winding machine as defined in claim 1 wherein the at least one component comprises a winding spindle which mounts at least one tube for receiving a wound package.

6. The winding machine as defined in claim 5 wherein the data module is connected to the controller via a plug-in connection.

7. The winding machine as defined in claim 1 wherein the components include a winding spindle which mounts at least one tube for receiving a wound package, and a contact roll positioned to lie against the circumference of the wound package during the winding of the yarn.

8. The winding machine as defined in claim 7 wherein a separate data module is affixed to each of the winding spindle and the contact roll, with each of the data modules being connected to the controller so as to be writable and/or readable by the controller.

9. The winding machine as defined in claim 8 further comprising a separate sensor for detecting operating data of each of the winding spindle and the contact roll, with each sensor being connected to the controller.

10. The method of winding an advancing yarn into a package on a winding machine which comprises a plurality of components which are rotatably mounted on a frame and driven by separate drives, with a data module affixed to at least one of the components and which contains stored operating data of the at least one component, wherein the data module and the at least one component are removably mounted to the frame so as to permit them to be exchanged, comprising the steps of reading the stored data by a controller, and then utilizing the stored data in the controller for controlling the drive of the at least one component as a function of the stored data.

11. The method of claim 10 wherein the operating data contain information about allowable load cycles of the at least one component, and wherein the step of utilizing the stored data in the controller includes comparing load cycles ($L_A$) completed by the at least one component with the allowable load cycles ($L_{MAX}$), and upon the completed load cycles exceeding the allowable load cycles ($L_A > L_{MAX}$), generating an alarm signal.

12. The method as defined in claim 10 wherein the data in the data module is overwritable and/or modifiable.

13. The method of winding an advancing yarn into a package on a winding machine which comprises a plurality of components which are rotatably mounted on a frame and driven by separate drives, with a data module affixed to at least one of the components, wherein the data module and the at least one component are removably mounted to the frame so as to permit them to be exchanged, comprising the steps of sensing operating data from the at least one component and storing the sensed operating data in the data module, reading the stored data by a controller, and then utilizing the stored data in the controller for controlling the drive of the at least one component as a function of the stored data.

14. The method of claim 13 wherein the operating data contain information about allowable load cycles of the at least one component, and wherein the step of utilizing the stored data in the controller includes comparing load cycles ($L_A$) completed by the at least one component with the allowable load cycles ($L_{MAX}$), and upon the completed load cycles exceeding the allowable load cycles ($L_A > L_{MAX}$) generating an alarm signal.

15. The method as defined in claim 13 wherein the data in the data module is overwritable and/or modifiable.

16. A winding machine for winding at least one advancing yarn into a package, comprising a winding spindle removably mounted for rotation on a machine frame and which is configured for coaxially mounting at least one tube for receiving a wound yarn package, a drive for rotatably driving the winding spindle, a controller for controlling the drive, and a data module permanently affixed to the winding spindle and being connected to the controller by a releasable connection so as to permit the winding spindle and affixed data module to be exchanged.

17. The winding machine as defined in claim 16 further comprising a contact roll positioned to lie against the circumference of the wound yarn package during winding of the yarn.

18. The winding machine as defined in claim 17 wherein the contact roll is rotatably driven by a separate drive which is connected to the controller.

19. The winding machine as defined in claim 18 further comprising a yarn traversing mechanism positioned upstream of the contact roll along the path of the advancing yarn and which is driven by a transverse drive which is connected to the controller.

* * * * *